US009290889B2

(12) United States Patent
Choo

(10) Patent No.: US 9,290,889 B2
(45) Date of Patent: Mar. 22, 2016

(54) DECK FASTENING DEVICE

(76) Inventor: Young Doo Choo, Daejeon (KR)

( * ) Notice: Subject to any disclaimer, the term of this patent is extended or adjusted under 35 U.S.C. 154(b) by 0 days.

(21) Appl. No.: 13/981,351

(22) PCT Filed: Dec. 16, 2011

(86) PCT No.: PCT/KR2011/009714

§ 371 (c)(1),
(2), (4) Date: Jul. 24, 2013

(87) PCT Pub. No.: WO2012/102482

PCT Pub. Date: Aug. 2, 2012

(65) Prior Publication Data

US 2013/0291471 A1 Nov. 7, 2013

(30) Foreign Application Priority Data

Jan. 25, 2011 (KR) ..... 10-2011-0007256

(51) Int. Cl.

| | |
|---|---|
| ***E04B 2/30*** | (2006.01) |
| ***E01C 5/14*** | (2006.01) |
| ***E04F 15/02*** | (2006.01) |
| ***E04F 15/04*** | (2006.01) |

(52) U.S. Cl.

CPC . *E01C 5/14* (2013.01); *E04F 15/02* (2013.01); *E04F 15/04* (2013.01)

(58) Field of Classification Search

CPC ..... E04B 9/26; E04B 9/22; E04B 1/003; E04B 9/24; E04B 2/08; F16B 5/06; F16B 5/0004; F16B 5/0657; E04F 15/04; E04F 21/1855; E04F 2201/01

USPC ..... 52/483.1, 489.1, 489.2, 385, 386, 698, 52/702, 710, 712, 713, 715; 411/461, 462, 411/463, 466

See application file for complete search history.

(56) References Cited

U.S. PATENT DOCUMENTS 2,025,794 A * 12/1935 Venzie ..... 52/355
2,129,975 A * 9/1938 Urbain ..... 52/489.2
2,915,795 A * 12/1959 Kendall ..... 52/393

(Continued)

FOREIGN PATENT DOCUMENTS

CN 2895605 Y 5/2007
JP 08-128125 A 5/1996

*Primary Examiner* — Brian Glessner
*Assistant Examiner* — Gisele Ford
(74) *Attorney, Agent, or Firm* — Roberts Mlotkowski Safran & Cole, P.C.

(57) ABSTRACT

A square-shaped deck plank fastening device is provided that connects deck planks together without the need for fasteners on the top surfaces of the planks. The deck plank fastening device is connected to a lower surface of a deck plank and includes: a plurality of first projecting surfaces formed to extend upwards from corners on one side of the fastening device in a width direction of the plank, and a plurality of second projecting surfaces formed to extend upwards from corners on an opposite side of the fastening device in the width direction. A plurality of flat, tongue-like fastening parts extend from a mid-portion of a side of the deck plank fastening device in the width direction parallel to the first projecting surfaces. A first extending part extends from a mid-portion of a side of the deck plank fastening device opposite to the tongue-like fastening parts in the width direction parallel to the second projecting surfaces. The first extending part has a plurality of slot-like insertion parts formed in the width direction to receive the tongue-like fastening parts of an adjacent deck plank fastening device.

13 Claims, 5 Drawing Sheets

(56) References Cited

U.S. PATENT DOCUMENTS

| | | | | | |
|---|---|---|---|---|---|
| 3,553,919 | A * | 1/1971 | Urbain | 52/506.1 |
| 3,577,694 | A * | 5/1971 | Omholt | 52/506.1 |
| 4,333,286 | A * | 6/1982 | Weinar | 52/281 |
| 4,448,007 | A * | 5/1984 | Adams | 52/489.2 |
| 4,467,579 | A * | 8/1984 | Weinar | 52/281 |
| 4,567,706 | A * | 2/1986 | Wendt | 52/489.2 |
| 4,621,473 | A * | 11/1986 | Wendt | 52/489.2 |
| 5,363,620 | A * | 11/1994 | Liu | 52/482 |
| 5,390,457 | A * | 2/1995 | Sjolander | 52/387 |
| 5,417,020 | A * | 5/1995 | Dobija | 52/235 |
| 5,966,893 | A * | 10/1999 | Quillin | 52/713 |
| 6,266,937 | B1 * | 7/2001 | Watanabe | 52/489.2 |
| 6,279,286 | B1 * | 8/2001 | Ichihashi | 52/489.1 |
| 6,332,299 | B1 * | 12/2001 | Stewart, III | 52/696 |
| 6,497,395 | B1 * | 12/2002 | Croker | 248/300 |
| 6,880,306 | B2 * | 4/2005 | Burken et al. | 52/483.1 |
| 7,251,918 | B2 | 8/2007 | Reif et al. | |
| 7,398,623 | B2 * | 7/2008 | Martel et al. | 52/489.2 |
| 7,730,694 | B1 * | 6/2010 | Simpson et al. | 52/713 |
| 7,748,187 | B2 * | 7/2010 | Sensenig | 52/489.1 |
| 8,011,153 | B2 * | 9/2011 | Orchard | 52/489.1 |
| 8,146,303 | B2 * | 4/2012 | Gibson et al. | 52/177 |
| D663,612 | S * | 7/2012 | Pelc | D8/382 |
| 8,225,571 | B2 * | 7/2012 | Orchard | 52/489.1 |
| 8,393,125 | B2 * | 3/2013 | Martel | 52/489.1 |
| 8,516,769 | B2 * | 8/2013 | Hanig et al. | 52/715 |
| 8,555,570 | B2 * | 10/2013 | Martel | 52/177 |
| 8,555,592 | B2 * | 10/2013 | Daudet et al. | 52/489.1 |
| 2001/0015042 | A1 * | 8/2001 | Ballard | 52/589.1 |
| 2003/0121226 | A1 * | 7/2003 | Bolduc | 52/391 |

* cited by examiner

DECK FASTENING DEVICE

CROSS-REFERENCE TO RELATED APPLICATIONS

This application claims the benefit of Korean Patent Application No. 10-2011-00077256, filed on Jan. 25, 2011 in the Korean Intellectual Property Office, the disclosure of which is incorporated herein by reference.

BACKGROUND OF THE INVENTION

1. Field of the Invention

The present invention relates to a fastening device for connecting wooden decks used for a mountaineering trail, a walking trail, a sidewalk, a terrace, or a bike lane, and more particularly, to a wooden deck fastening device capable of suppressing deformation of a wooden deck to a minimum extent even though the wooden deck is deformed due to contraction or expansion caused by sunlight, temperature and humidity and not allowing a fixing means to be exposed to the outside when the wooden deck is constructed by fastening by a fastening device.

2. Description of the Related Art

In recent years, there is a boom for environmentally friendly landscaping in society. For this reason, a wooden deck is more nature-friendly than other materials used for a floor of a mountaineering trail, a walking trail, a sidewalk, or a terrace of a house, and can efficiently absorb shock and shaking to create a quiet environment. Furthermore, an assembly wooden deck that can give people a visually soft and comfortable feeling is primarily used for a floor finishing material.

The assembly wooden deck has excellent durability and is convenient for maintenance, and there is an advantage in that the assembly wooden deck has good elasticity and a fine shock absorbing function during walking to make a pedestrian less tired.

In general, a conventional wooden deck structure is installed such that lower structure are installed at a bottom surface of an installation place in a certain form, wooden decks are fit to each other on the lower structures in an assembly manner, and the lower structures and the wooden decks are fixed by being connected to each other by using a fixing means such as nail.

In order to fix the wooden decks, since a fixing means such as a nail, a rivet, or a bolt is used, a hole is formed in the wooden deck or a nail is hammered into the wooden deck, so that a material is directly damaged.

Thus, there is a problem that snow and rain permeate through the damaged portion to degrade durability of the material itself and cracks or splits are caused in the wooden material. Further, it takes a long time to construct the decks and personnel expenses are increased.

In particular, since the aforementioned fixing means is used, there is a problem that a body of a pedestrian with naked feet is wounded due to the fixing means protruding at the outside.

Furthermore, when the wooden deck is deformed due to sunlight, temperature, and humidity, the wooden deck slides in a short side direction. However, the expansion and contraction of the wooden deck primarily occur in a longitudinal direction of the wooden deck in many cases, and the wooden deck is fixed to a support by a bolt. For this reason, since deformation in the longitudinal is not absorbed, an original state of the wooden deck may not be maintained. Furthermore, when constructing the wooden deck, a connection hole needs to be formed in the wooden deck. In this way, since secondary processing is performed on the wooden deck in the installation place, there is a problem about a rise of manufacturing cost in addition to a construction problem.

In order to solve the aforementioned problems, there are various patent applications in which a groove is formed at a side surface of a wooden material, and a fastening member is connected to the groove so as not to expose a fixing means to the outside. However, when the wooden deck is contracted or expanded, the fastening member is separated from the wooden deck. Thus, when a user walks on the wooden deck, since the wooden deck is wobbling, there is a problem that the wooden deck is broken due to the shaking.

SUMMARY OF THE INVENTION

In order to solve the aforementioned problems, an aspect of the present invention provides a wooden deck fastening device capable of not allowing a wooden deck to be separated from a fastening device while the wooden deck is not twisted or damaged even though the wooden deck used for a floor of a mountaineering trail, a walking trail, a sidewalk, or a terrace of a house is deformed due to contraction or expansion caused by sunlight, temperature and humidity.

An aspect of the present invention also provides a wooden deck fastening device capable of improving durability of a wooden deck by absorbing deformation of the wooded deck, and reducing maintenance cost of the wooden deck that has been constructed once while the fastening device is connected to a lower surface of the wooden deck so as not to expose a connected portion to the outside and the wooden deck is easily constructed.

According to an aspect of the present invention, there is provided a square-shaped wooden deck fastening device (100) that is connected to a lower surface of a wooden deck. The device includes a plurality of first projecting surfaces (110) that is formed to extend upwards from corners on one side of the fastening device (100) in a width direction; a plurality of second projecting surfaces (120) that is formed to extend upwards from corners on the other side of the fastening device (100) in the width direction; a plurality of fastening parts (130) that is formed to be cut away and extends in the width direction to be parallel to the first projecting surfaces (110); and a first extending part (140) that is formed opposite the fastening parts (130), extends on the other side in the width direction to be parallel to the second projecting surfaces (120), and is provided with a plurality of insertion parts (141) formed in the width direction to protrude upwards. The fastening parts (130) may be fixed by being inserted into the insertion parts (141) of the first extending part (140).

Further, the fastening parts (130) and the first extending part (140) may be formed at a central portion of the fastening device (100).

Furthermore, in the fastening device (100), a plurality of deck fastening holes (111) may be bored in the first projecting surfaces (110) and the second projecting surfaces (120), and a plurality of support fastening holes (142) may be bored in the first extending part (140).

Moreover, a bent part (160) may be formed outside the second projecting surface (120) in the width direction to be bent upwards, and the bent part (160) may be fastened by coming closely into contact with a side surface of the deck (200).

In addition, the bent part (160) may have a "reverse-L" shape, and the bent part (160) may be fixed by being inserted into a first insertion groove (210) of the deck (200).

The wooden deck fastening device may further include a second extending part (180) that is formed outside the first projecting surface (110) in the width direction to be lower than the first projecting surface in height. When the fastening device (100) is fastened to another fastening device (100), the second extending part (180) may be inserted under the second projecting surface (120) of the fastening device (100).

The wooden deck fastening device may further include a connection member (170) that is connected to an upper central portion of the fastening device (100) in the width direction.

Furthermore, the connection member (170) may have a plurality of connection member-bent parts (171) that is formed to be bent, and the connection member-bent parts (171) may be inserted into a second insertion groove (220) to fix the deck (200).

Moreover, a plurality of holes may be bored in the connection member (170), and the connection member (170) may be fixed by being connected onto a side surface of the deck (200) in a longitudinal direction and being inserted into the second insertion groove (220) formed at the deck (200) to be connected.

In addition, a protrusion (150) may be formed at the upper central portion of the fastening device (100) in the longitudinal direction.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

As set forth above, according to exemplary embodiments of the invention, in a wooden deck fastening device of the present invention, a plurality of fastening holes is formed, and a fastening device is connected to a lower surface of a wooden deck so as not to expose a connected portion to the outside. Accordingly, it is possible to improve fastening force by allowing the fastening device to be connected through the plurality of fastening holes, enable simple construction by allowing the fastening device to be connected in a sliding manner, and reduce maintenance cost.

Hereinafter, technical sprits of the present invention will be described in more detail with reference to the accompanying drawings.

However, the accompanying drawings are merely illustrated to describe the technical sprits of the present invention in more detail, and the technical sprits of the present invention are not limited by the accompanying drawings.

Figure 1:
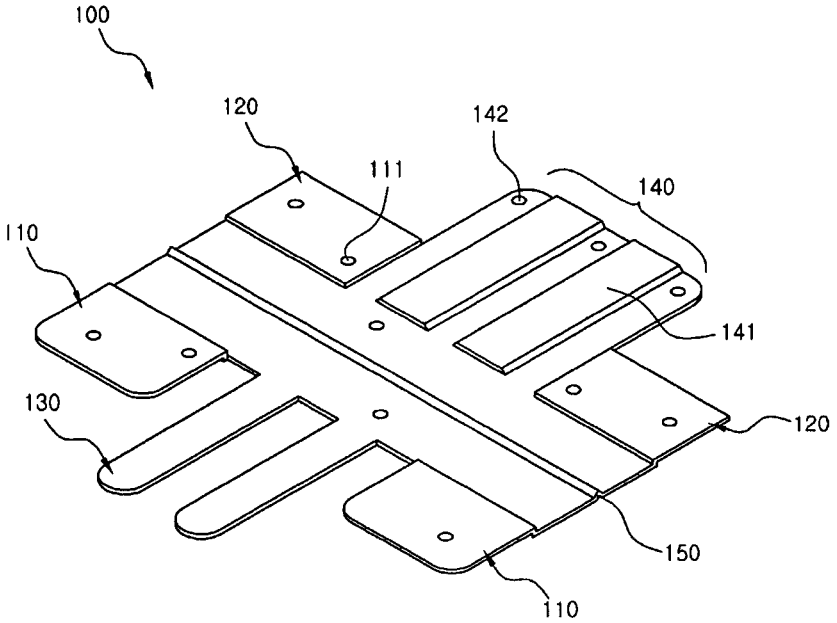
FIG. 1 is a perspective view of a wooden deck fastening device of the present invention.
Figure 2:
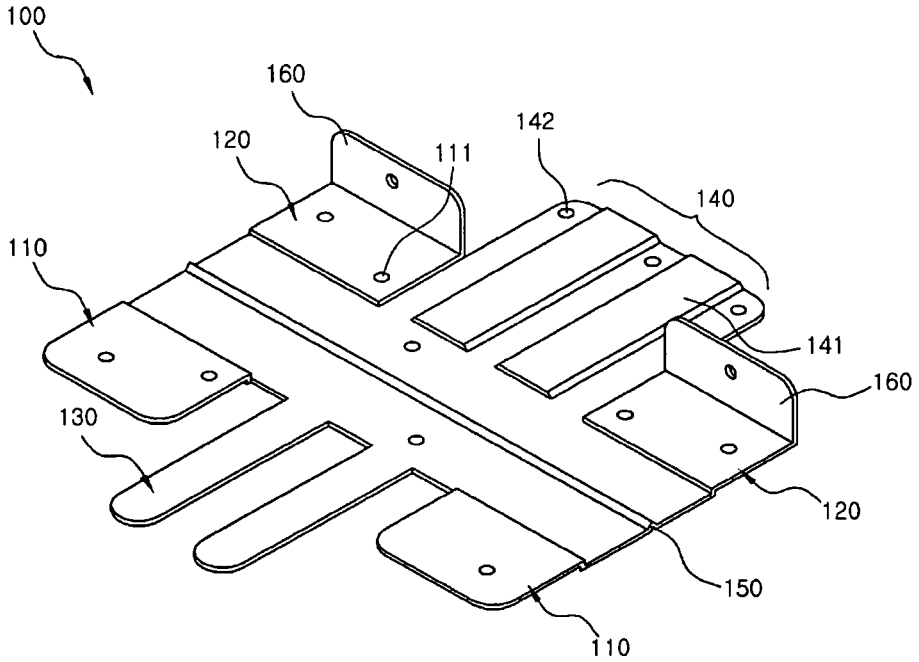
FIG. 2 is a perspective view of a wooden deck fastening device according to a first embodiment of the present invention.
Figure 3:
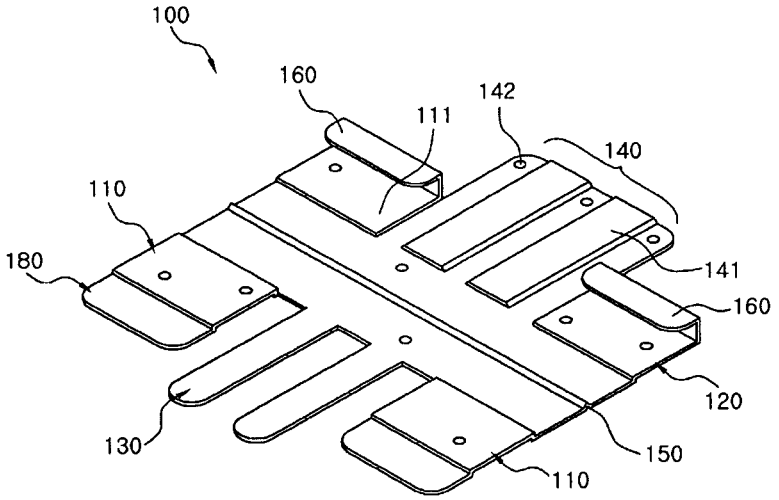
FIG. 3 is a perspective view of a wooden deck fastening device according to a second embodiment of the present invention.
Figure 4:
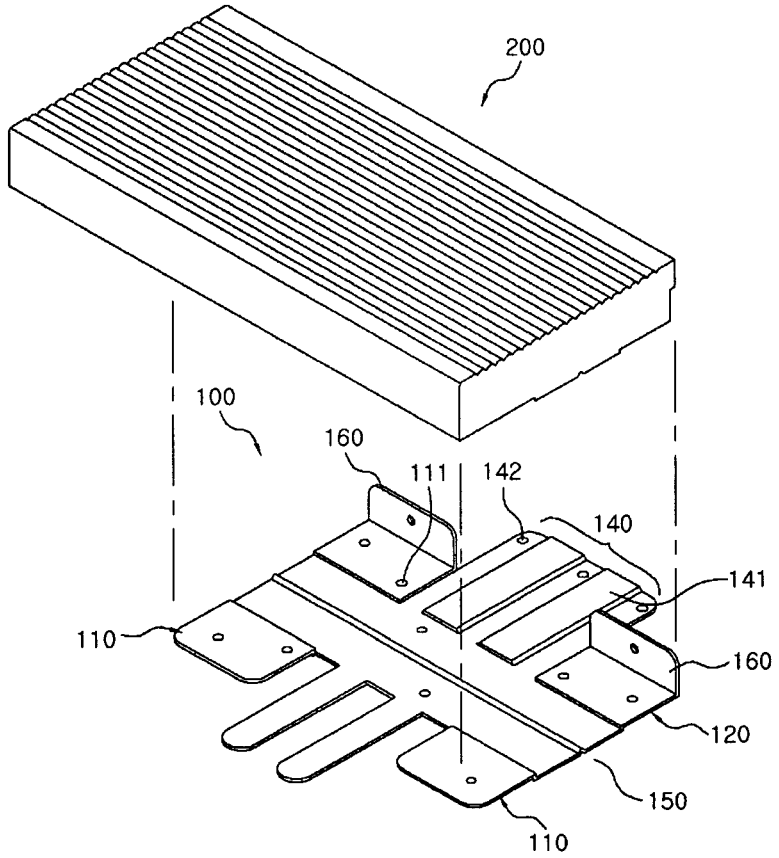
FIG. 4 is a perspective view illustrating a method of connecting a wooden deck and the wooden deck fastening device of the present invention.

An external appearance and structure of a fastening device 100 of a wooden deck 200 of the present invention will be described with reference to FIG. 1.

The fastening device 100 of the wooden deck 200 of the present invention includes a first projecting surface 110, a second projecting surface 120, a plurality of fastening parts 130, a first extending part 140, and a plurality of insertion parts 141.

The first projecting surface 110 is plural in number, and the first projecting surfaces are formed at corners on one side in a width direction. The second projecting surface 120 is plural in number, and the second projecting surfaces are formed at corners on the other side in the width direction.

The fastening parts 130 are formed to be cut away and extend in the width direction to be parallel to the first projecting surfaces 110.

The first extending part 140 is formed opposite the fastening parts (130), extends on the other side in the width direction to be parallel to the second projecting surface 120, and is provided with the plurality of insertion parts 141 formed in the width direction to protrude upwards.

At this time, when the fastening device 100 is connected to another fastening device 100, the fastening parts 130 of the another fastening device 100 are fixed by being inserted into the insertion parts 141 of the first extending part 140, so that the fastening devices are connected to each other.

The fastening parts 130 and the first extending part 140 are formed at a central portion of the fastening device 100.

That is, the fastening parts 130 are formed between the first projecting surfaces 110, and the first extending part 140 is formed between the second projecting surfaces 120.

Furthermore, a protrusion 150 is formed at an upper central portion of the fastening device 100 in a longitudinal direction, and a groove into which the protrusion 150 is inserted is formed at a lower surface of the deck 200. In such a configuration, when the fastening device 100 is connected to the deck 200, their central portions can be easily fastened.

A wooden deck fastening device 100 according to first and second embodiments of the present invention will be explained with reference to FIGS. 2 to 5, and a connected state of the wooden deck 200 and the fastening device 100 will be described in detail.

The wooden deck fastening device 100 of the present invention further includes a bent part 160 that is formed outside the second projecting surface 120 in the width direction to be bent upwards, so that it is possible to improve fastening force.

Moreover, when the fastening device 100 is connected to the deck 200, the bent part 160 comes closely in contact with a side surface of the deck 200 in the width direction, and is fastened onto the side surface of the deck 200 in the width direction by inserting a screw into a hole formed at the bent part 160.

In addition, the bent part 160 may have a "reverse-L" shape.

When the bent part 160 have the "reverse-L" shape, a first insertion groove 210 is formed on the side surface of the deck 200 in the width direction, and the bent part 160 is fixed by being inserted into the first insertion groove.

Figure 5:
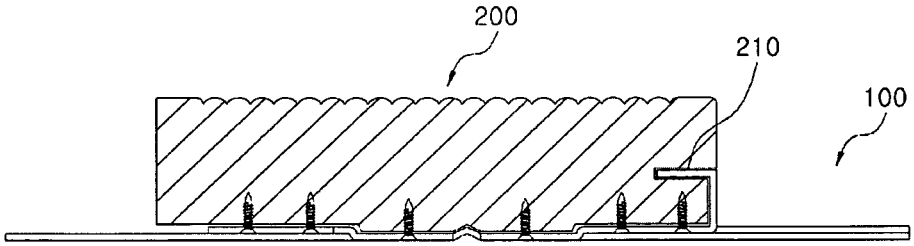
FIG. 5 is a cross-sectional view illustrating a connected state of the wooden deck and the wooden deck fastening device according to the second embodiment of the present invention.

FIG. 5 is a cross-sectional view illustrating the connected state of the deck 200 and the fastening device according to the second embodiment of the present invention.

In order to fix the fastening device 100 to the deck 200, a plurality of deck fastening holes 111 is bored in the first projecting surfaces 110 and the second projecting surfaces 120, and screws are inserted into the deck fastening holes 111, so that the fastening device 100 is fixed by coming closely in contact with the lower surface of the deck 200.

At this time, in order to come closely in contact with the fastening device 100, the deck 200 is preferably formed in the same shape as that of the fastening device 100.

Furthermore, the deck fastening hole 111 is preferably formed to be tapered upwards so as not to expose the screw at a lower surface of the fastening device 100.

Figure 6:
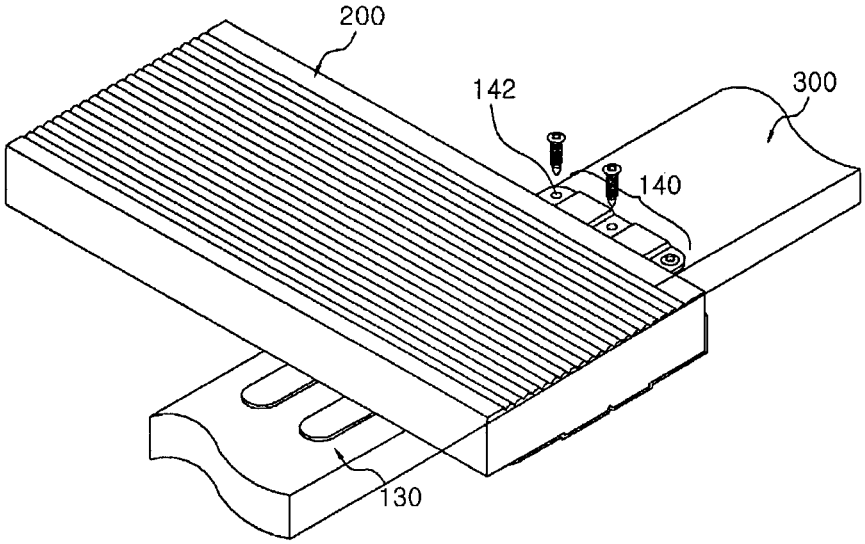
FIG. 6 is a perspective view illustrating a method of connecting a lower support and the wooden deck fastening device of the present invention.

FIG. 6 is a perspective view illustrating a method of connecting a lower support and the wooden deck fastening device 100 of the present invention.

In order to fix the fastening device 100 connected with the deck 200 to the lower support, a plurality of support fastening holes 142 is bored in the first extending part 140.

More particularly, the plurality of support fastening holes 142 is bored in the first extending part 140 exposed to the outside when the deck 200 is connected to the fastening device 100, and screws are inserted into the support fastening holes 142, so that the fastening device 100 is fixed to a supporting member 300.

At this time, the support fastening hole 142 is preferably formed to be tapered downwards so as not to expose the screw at an upper surface of the fastening device 100 when the screw is screwed downwards from the top.

Figure 7:
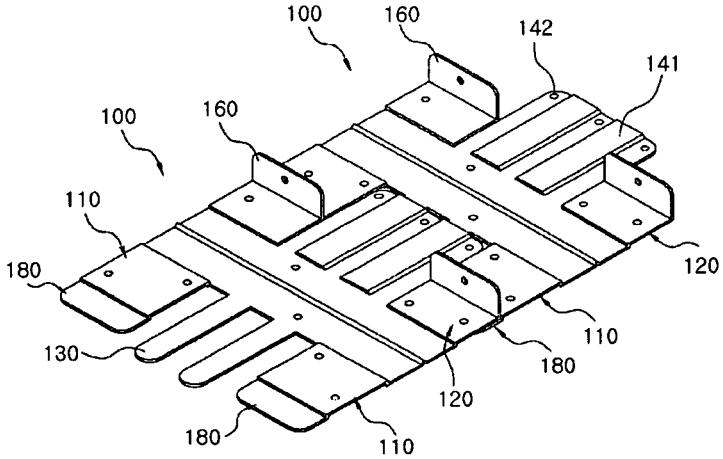
FIG. 7 is a perspective view illustrating a connected state of the wooden deck fastening device of the present invention.
Figure 8:
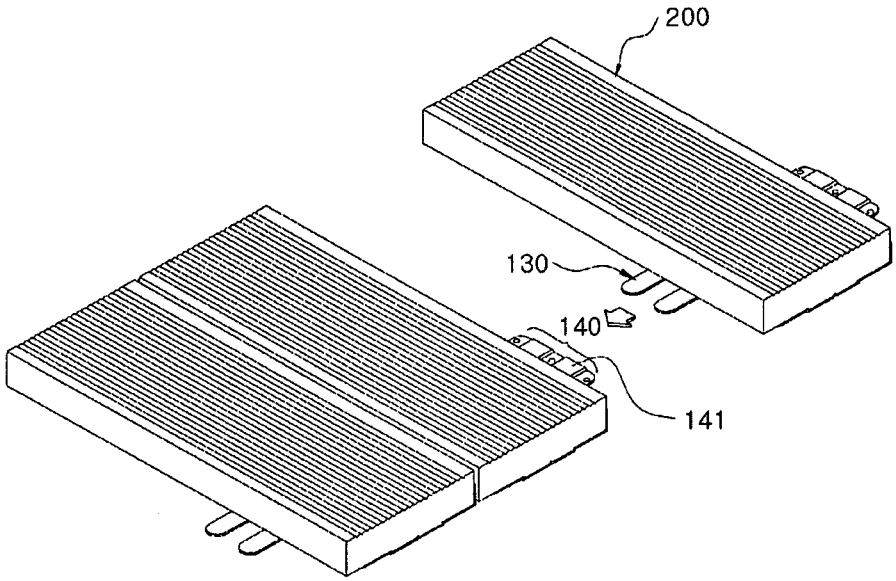
FIG. 8 is a perspective view illustrating a method of connecting the wooden deck fastening device of the present invention.

A method of connecting the wooden deck fastening device 100 of the present invention will be described with reference to FIGS. 7 and 8.

When the fastening device 100 is connected to another fastening device 100, the plurality of fastening parts 130, which is formed to be cut away and extends in the width direction to be parallel to the first projecting surfaces 110, under the insertion parts 141 formed at the first extending part 140, so that the fastening devices are fixed to each other.

Furthermore, the fastening device may further include a second extending part 180 that is formed outside the first projecting surface 110 in the width direction to be lower than the first projecting surface in height.

At this time, when the fastening devices 100 are connected to each other, since the second extending part 180 is fixed by being inserted under the second projecting surface 120, the fastening force of the fastening device 100 to the deck 200 can be more increased.

Figure 9:
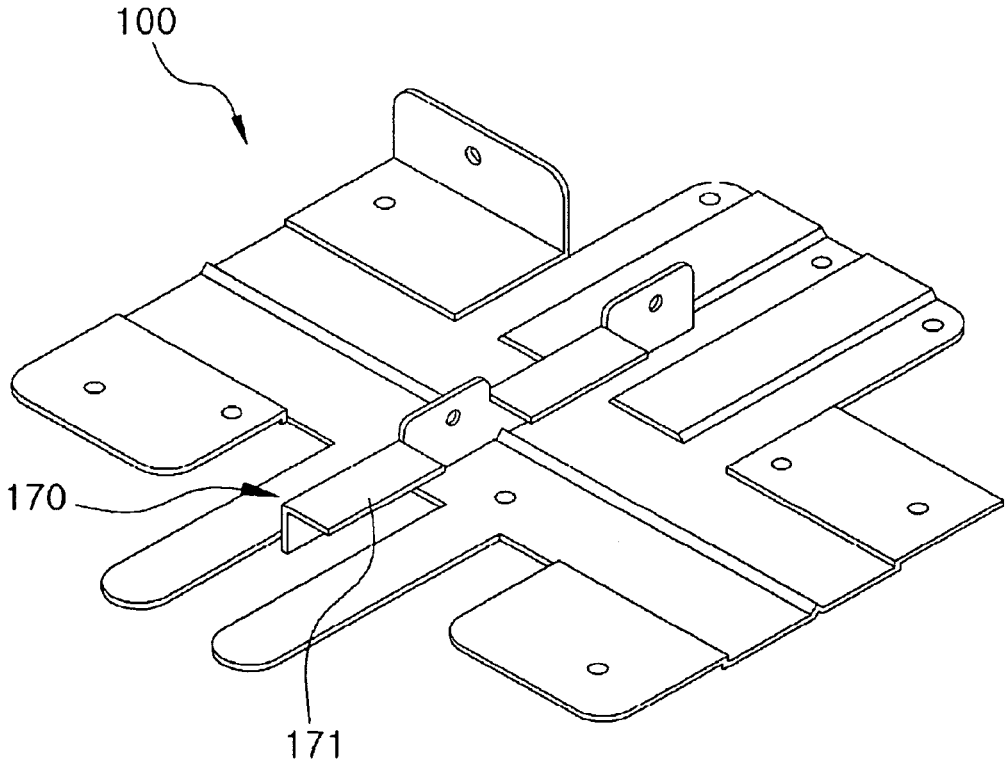
FIG. 9 is a perspective view of a wooden deck fastening device according to a third embodiment of the present invention.
Figure 10:
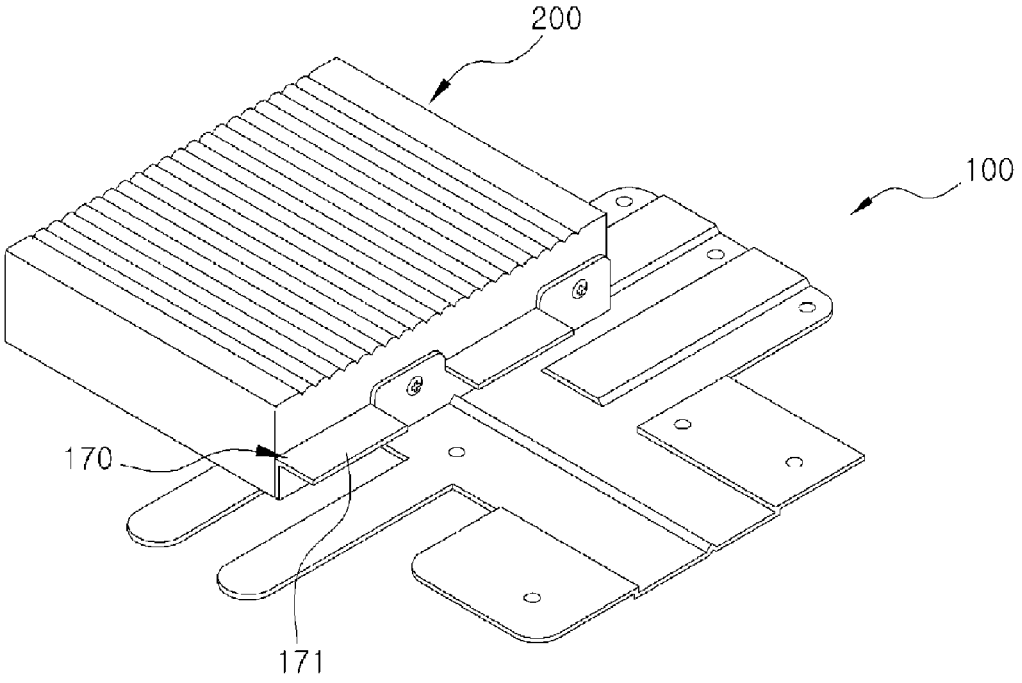
FIG. 10 is a perspective view illustrating a fastened state of the wooden deck fastening device according to the third embodiment of the present invention.
Figure 11:
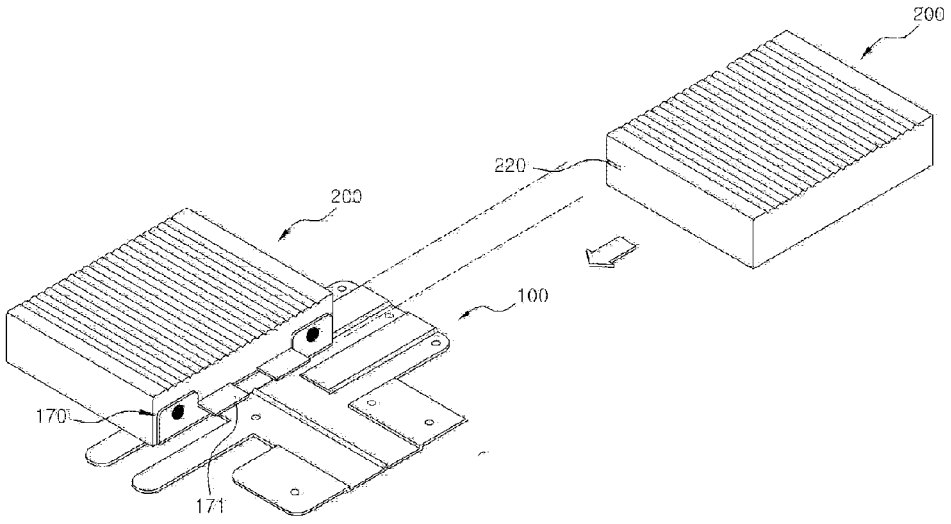
FIG. 11 is a perspective view illustrating a method of fastening the wooden deck fastening device according to the third embodiment of the present invention.

An external appearance and a fastening method of a wooden deck fastening device 100 according to a third embodiment of the present invention will be described with reference to FIGS. 9 to 11.

When the deck 200 and the deck 200 are connected to each other in a longitudinal direction, the fastening device 100 according to the third embodiment is positioned between the deck 200 and the deck 200 to connect the decks 200.

The fastening device 100 further includes a connection member 170 that is connected to an upper central portion of the fastening device 100 in the width direction.

A plurality of connection member-bent parts 171 that is formed to be bent is formed at the connection member 170, and the connection member-bent parts 171 are inserted into a second insertion groove 220 formed at a side surface of the deck 200 in the longitudinal direction, so that the deck 200 is fixed to the connection member 170. Accordingly, connecting force of the deck 200 and the deck 200 in the longitudinal direction can be improved.

Furthermore, the connection member 170 is provided with a plurality of holes, and is connected onto the side surface of one deck 200 in the longitudinal direction by inserting screws into the holes. Then, the connection member-bent parts 171 are slidably inserted into the second insertion groove 220 formed at the side surface of another deck 200 (to be connected) in the longitudinal direction. Thus, the connection member is fixed to the deck.

Here, the hole bored in the connection member 170 is preferably bored in a direction in which the deck 200 is connected so as not to cause inconvenience in screwing the screw.

Accordingly, the plurality of fastening holes 111 and 142 are formed in the wooden deck fastening device 100 of the present invention, and the fastening device 100 is connected to the lower surface of the deck 200. Thus, fixing means are not exposed at the upper surface of the deck 200, and the fastening device 100 and the deck 200 are connected to each other through the plurality of fastening holes 111 and 142. Accordingly, it is possible to improve fastening force. Furthermore, the fastening device and the deck are connected to each other in a sliding manner to enable simple construction. Accordingly, it is possible to reduce maintenance cost.

In addition, since the bent parts 171 are formed at the connection member 170, it is possible to further improve fastening force of the connection member 170 to the deck.

What is claimed is:

1. A deck fastening device connected to a bottom surface of a deck plank, the plank having a width and a length, the device comprising:

a plurality of first projecting surfaces extending in a width direction of the deck plank at corners on one side of the fastening device, wherein the first projecting surfaces are offset from a bottom surface of the fastening device and define a portion of a top surface of the fastening device, wherein the top surface of the fastening device is configured to be in contact with the bottom surface of the deck plank;

a plurality of second projecting surfaces extending in an opposite width direction of the first projecting surfaces at corners on an opposite side of the fastening device, wherein the second projecting surfaces are offset from the bottom surface of the fastening device and define another portion of the top surface of the fastening device;

a plurality of fastening parts extending in the same direction as the first projecting surfaces and being parallel to the first projecting surfaces; and a first extending part extending in the same direction as the second projecting surfaces and being parallel to the second projecting surfaces, wherein the first extending part is provided with a plurality of insertion parts;

wherein the fastening device is configured to fastened to another fastening device by inserting fastening parts of the another fastening device into the insertion parts of the first extending part of the fastening device.

2. The deck fastening device according to claim 1, wherein the fastening parts and the first extending part of the fastening device are formed at and extend in opposite directions from a central portion of the fastening device.

3. The deck fastening device according to claim 1, wherein a plurality of deck fastening holes are bored in the first projecting surfaces and the second projecting surfaces, and a plurality of support fastening holes are bored in the first extending part.

4. The deck fastening device according to claim 3, further comprising:

a bent part bent from each of the second projecting surfaces so as to extend upwardly in engagement with a side surface of the deck plank so that the fastening device is in contact with the side surface of the deck plank.

5. The deck fastening device according to claim 4, wherein the bent part is bent orthogonally with respect to the second projecting surfaces, and the bent part is fixed to the deck plank by being inserted into a first insertion groove of the deck plank.

6. The deck fastening device according to claim 2, further comprising:

second extending parts extending from the first projecting surfaces which are offset toward the bottom surface of the fastening device, wherein when the fastening device is fastened to the another fastening device, the second extending parts are inserted under a second projecting surface of the another fastening device.

7. The deck fastening device according to claim 6, further comprising:

a connection member connected to a central portion of the fastening device and extending in the width direction of the deck plank.

8. The deck fastening device according to claim 7, wherein the connection member has a plurality of connection member bent parts inserted into a second insertion groove to fix the deck plank.

9. The deck fastening device according to claim 8, wherein a plurality of holes are bored in the connection member, and the connection member is fixed by being connected onto a side surface of the deck plank in the widthwise direction of the deck plank by means of fasteners inserted through the plurality of holes.

10. The deck fastening device according to claim 9, wherein the fastening device has an upwardly-extending protrusion formed at the central portion of the fastening device in the longitudinal direction of the deck plank.

11. The deck fastening device according to claim 3, further comprising:

second extending parts which are offset toward the bottom surface of the fastening device, wherein when the fastening device is fastened to the another fastening device, the second extending parts are inserted beneath a second projecting surface of the another fastening device.

12. The deck fastening device according to claim 4, further comprising:

second extending parts which are offset toward the bottom surface of the fastening device, wherein when the fastening device is fastened to the another fastening device, the second extending parts are inserted beneath a second projecting surface of the another fastening device.

13. The deck fastening device according to claim 5, further comprising:

second extending parts which are offset toward the bottom surface of the fastening device, wherein when the fastening device is fastened to the another fastening device, the second extending parts are inserted beneath a second projecting surface of the another fastening device.

* * * * *